US006094140A

United States Patent [19]

Parente

[11] Patent Number: 6,094,140

[45] Date of Patent: Jul. 25, 2000

[54] PORTABLE ALARM SYSTEM

[76] Inventor: Thomas G Parente, P.O. Box 113, Yaphank, N.Y. 11980

[21] Appl. No.: 09/221,445

[22] Filed: Dec. 22, 1998

[51] Int. Cl.[7] ..... G08B 23/00

[52] U.S. Cl. ..... 340/573.1; 340/539; 340/531; 340/505; 340/628; 340/567; 340/451; 379/37; 379/38

[58] Field of Search ..... 340/573.1, 539, 340/531, 567, 451, 505, 628, 573, 825.37, 164 R; 379/37, 38

[56] References Cited

U.S. PATENT DOCUMENTS

| | | | |
|---|---|---|---|
| 3,925,763 | 12/1975 | Wadhwani et al. | 340/164 R |
| 4,176,343 | 11/1979 | Moore | 340/286 |
| 4,335,377 | 6/1982 | Bostic | 340/573 |
| 4,908,604 | 3/1990 | Jacob | 340/539 |
| 5,087,908 | 2/1992 | Sanders, Jr. | 340/567 |
| 5,564,429 | 10/1996 | Bornn et al. | 128/696 |
| 5,565,844 | 10/1996 | Bedrosian | 340/567 |
| 5,629,687 | 5/1997 | Sutton et al. | 340/825.37 |
| 5,729,203 | 3/1998 | Oka et al. | 340/573 |
| 5,850,180 | 12/1998 | Hess | 340/451 |
| 5,889,468 | 3/1999 | Banga | 340/628 |
| 5,898,367 | 4/1999 | Berube | 340/505 |

*Primary Examiner*—Daniel J. Wu
*Assistant Examiner*—Tai T. Nguyen
*Attorney, Agent, or Firm*—Michael I. Kroll

[57] ABSTRACT

A portable alarm system for alerting a central station of an emergency. The portable alarm system includes a central unit for monitoring a desired area and a remote control unit for activating and signaling the central unit. The central unit includes a detector for detecting an emergency situation and generating a signal in response thereto, a processor for receiving the detection signal and generating an alarm signal in response thereto, a receiver for receiving an emergency signal and providing the emergency signal to the processor and an alarm for alerting the central station upon receipt of one of the alarm signal and emergency signal. The remote control unit includes a device for generating the emergency signal upon receipt of a user generated command and a transmitter for transmitting the emergency signal to the receiver of the central unit. The detection device is a motion detector for detecting motion in an area surrounding the central unit and the remote control unit includes an activation button for generating a signal for activating the motion detector. The remote control unit further includes a button for generating a medical emergency signal and a panic signal for transmission to the central unit. The transmitter includes at least one of a modem for connecting to and transmitting the alarm signal to the central station via telephone lines and a wireless transmitter for wirelessly transmitting the alarm signal to the central station.

1 Claim, 6 Drawing Sheets

PORTABLE ALARM SYSTEM

BACKGROUND OF THE INVENTION

1. Field of the Invention

The present invention relates generally to alarm systems and, more specifically, to a portable alarm system including a remote control alarm activator able to monitor movement within a predetermined range from a central unit and contact a central station upon detecting an emergency situation.

2. Description of the Prior Art

Numerous types of alarm systems have been provided in the prior art. For example, U.S. Pat. Nos. 3,594,768; 4,810,998; 5,463,595 and 5,760,687 all are illustrative of such prior art. While these units may be suitable for the particular purpose to which they address, they would not be as suitable for the purposes of the present invention as heretofore described.

A motion detecting device utilizing an ultrasonic radiator and an ultrasonic microphone in which the microphone is electrically connected to an audio detector, and the output of the audio detector is converted into pulses. Pulses having a repetition rate greater than a threshold value are accumulated and utilized to trigger a bistable multivibrator. The output of the multivibrator passes through a time delay device to an alarm, and the unit is provided with an electronic switch for deactuation during the period of time delay.

The interruption demonstrating and multi-phase burglar alarm system is started by signals from 2 or more than 2 detectors amplified and inputted into an interruption demonstrating circuit. By an outside interruption signal, the sensitivity will be properly adjusted. The device also has a multi-phase to detect in single or adjacent multiple areas. The two detectors will be activated within a pre-set period or will not trigger the alarm. The controlling circuit will reset the device in case of any improper or mistaken signals, thereby providing continuous protection and preventing false alarms.

A security system suitable for use in monitoring property at an outdoor site that includes a portable housing that supports a motion detector for sensing motion within a detection zone. The security system further includes an ultrasonic transducer and several alarm generators capable of repelling a human intruder, including a high intensity illumination source, high decibel siren, strobe light and a speaker for transmitting a prerecorded message. When an intrusion is initially detected by the motion detector, the ultrasonic transducer is activated to emit an ultrasonic signal that is irritating to nonhuman animals, thus clearing the detection zone of nonhuman intruders. If after sounding of the ultrasonic transducer motion is still detected, one or more of the alarms is activated. Additionally, an automatic telephone dialer may be included in the system and activated by the system as another type of alarm, in response to detected intrusion. The system is integrated within the portable housing and is resistant to false alarms, making it suitable for use in monitoring property stored at an outside site. A method for utilizing the security system to protect property is also disclosed.

The signal delivered by a Doppler sensor is treated after amplification, filtering and digitization by means for determining the global energy of the digitized signal, autocorrelation test means for showing up a dominant frequency, a filter for rejecting that frequency, comparators for eliminating signals having energy less than a threshold, a filter for isolating a particular frequency band, and means for intercorrelation with a reference signal held in memory.

SUMMARY OF THE PRESENT INVENTION

The present invention relates generally to alarm systems and, more specifically, to a portable alarm system including a remote control alarm activator able to monitor movement within a predetermined range from a central unit and contact a central station upon detecting an emergency situation.

A primary object of the present invention is to provide a portable alarm system that will overcome the shortcomings of prior art devices.

Another object of the present invention is to provide a portable alarm system which is able to monitor movement within a predetermined distance surrounding a central unit thereof.

A further object of the present invention is to provide a portable alarm system including a remote transmitter capable of activating the central unit to monitor movement within the predetermined area.

A yet further object of the present invention is to provide a portable alarm system wherein the remote control unit is able to activate the central unit to generate an alarm signal indicative of at least one of a medical emergency and a panic situation.

A still further object of the present invention is to provide a portable alarm system including a modem and telephone connector for communicating with a central station and relaying emergency signals thereto.

A further object of the present invention is to provide a portable alarm system having an audible alarm for generating an audible alarm signal upon detection of motion within the predetermined area.

A further object of the present invention is to provide a portable alarm system including an LED display on the central unit for alerting the user to the status of the central unit.

Another object of the present invention is to provide a portable alarm system that is simple and easy to use.

A still further object of the present invention is to provide a portable alarm system that is economical in cost to manufacture.

Additional objects of the present invention will appear as the description proceeds.

A portable alarm system for alerting a central station of an emergency is disclosed by the present invention. The portable alarm system includes a central unit for monitoring a desired area and a remote control unit for activating and signaling the central unit. The central unit includes a detector for detecting an emergency situation and generating a signal in response thereto, a processor for receiving the detection signal and generating an alarm signal in response thereto, a receiver for receiving an emergency signal and providing the emergency signal to the processor and an alarm for alerting the central station upon receipt of one of the alarm signal and emergency signal. The remote control unit includes a device for generating the emergency signal upon receipt of a user generated command and a transmitter for transmitting the emergency signal to the receiver of the central unit. The detection device is a motion detector for detecting motion in an area surrounding the central unit and the remote control unit includes an activation button for generating a signal for activating the motion detector. The remote control unit further includes a button for generating a medical emergency signal and a panic signal for transmission to the central unit. The transmitter includes at least one of a modem for connecting to and transmitting the alarm signal to the central station via telephone lines and a wireless transmitter for wirelessly transmitting the alarm signal to the central station.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS turning now descriptively to the drawings, in which similar reference characters denote similar elements throughout the several views, the Figures illustrate the portable alarm system of the present invention.

DETAILED DESCRIPTION OF THE PREFERRED EMBODIMENT

Figure 1:
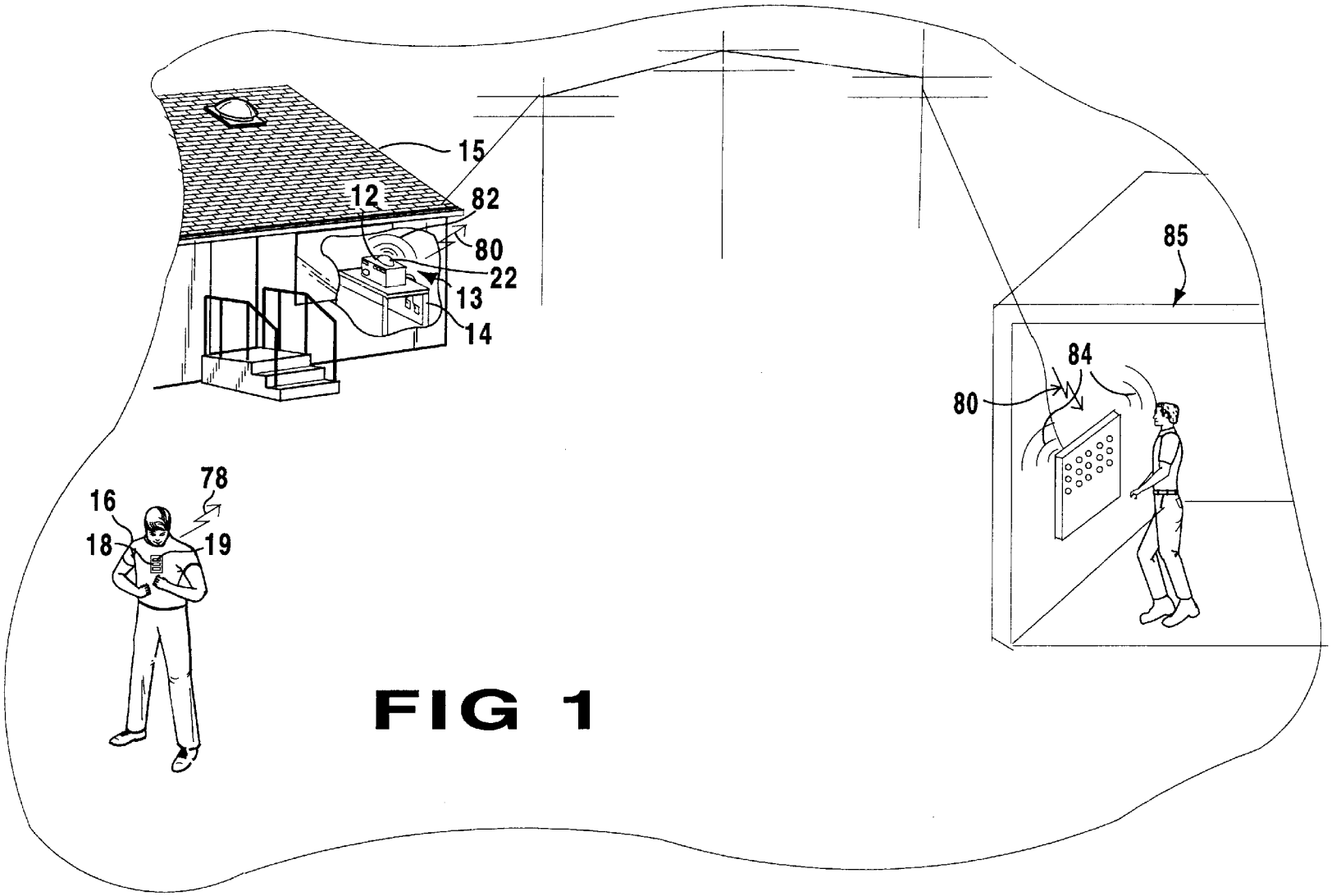
FIG. 1 is a perspective view of the portable alarm system of the present invention.

Turning now descriptively to the drawings, in which similar reference characters denote similar elements throughout the several views, FIGS. 1 through 7 illustrate the portable alarm system of the present invention indicated generally by the numeral 10.

The portable alarm system 10 is illustrated in FIG. 1 and includes a central unit 12 and a remote control unit 18. The central unit 12 is illustrated positioned on a table 14 within a room l3 in a building 15. The central unit 12 can be positioned in any room of the building or any place in which a telephone line connection is provided. The telephone line connection allows the central unit 12 to contact a central station 85 upon detecting an emergency situation. The remote control unit 18 is retained by a user 16 and may be used to activate the central unit 12 to begin monitoring the surrounding area for movement.

The user activates the central unit 12 by pressing one of the keys 19 on the remote control unit 18. In response to pressing of one of the keys 19, the remote control unit 18 generates a signal which is transmitted to the central unit 12. The signal generated by the remote control unit 18 is indicated by the arrow labeled with the numeral 78. The remote control unit 18 is able to transmit signals 78 which either activate the central unit 12 to begin monitoring an area for motion, cause the central unit 12 to generate a panic alarm signal or cause the central unit 12 to generate a medical alarm signal. The signal transmitted to the central unit 12 is dependent upon which key 19 of the remote control unit 18 is pressed.

The central unit 12 receives the signal 78 transmitted from the remote control unit 18 and process the signal to determine the course of action required. If a medical alarm key or a panic alarm key of the remote control unit 18 is pressed, the central unit 12 generates an alarm signal to be transmitted via telephone. If the activation key is pressed, the central unit 12 will activate a motion sensor 22 which monitors the desired area for motion and upon detection of any motion generates an alarm signal indicative of such. The signal generated by the central unit 12 is indicated by the arrow labeled with the numeral 80. This signal is transmitted to a central station 85 along conventional telephone lines. Upon receipt of the signal 80, the central station 85 alerts the proper authorities as to the possibility of an emergency at the central unit 12. When an alarm signal 80 is generated, the central unit 12 also produces an audible alarm indicated by the lines labeled with the numeral 82. This alerts persons in the area surrounding the central unit 12 as to the possible emergency situation. Upon receiving the alarm signal 80, the central station 85 may also produce an audible alarm signal indicated by the lines labeled with the numeral 84.

Figure 2:
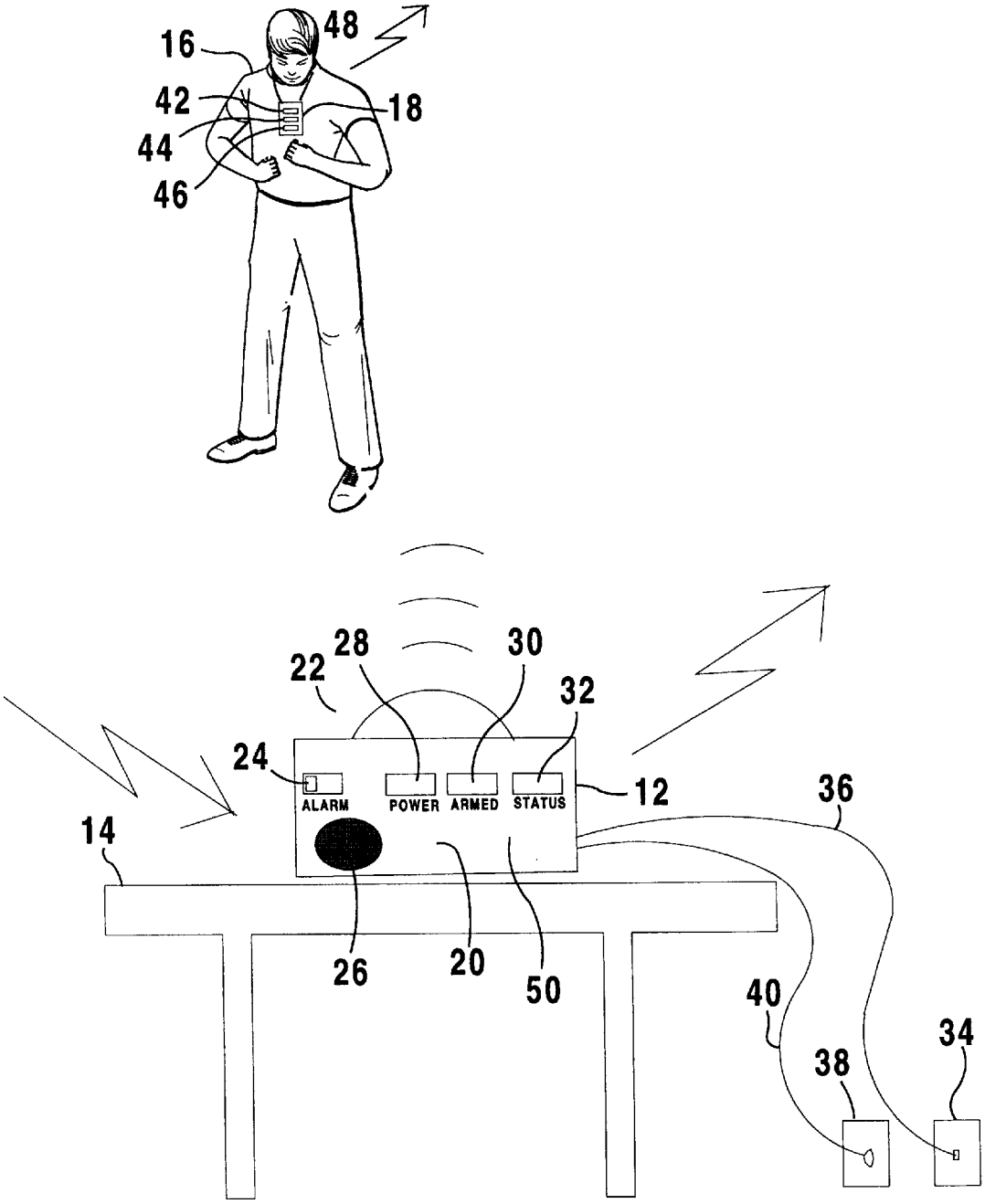
FIG. 2 is a top perspective view of the portable alarm system of the present invention wherein the central unit is positioned on a table for monitoring an area surrounding the table and a user having the remote control unit hanging around the neck.
Figure 3:
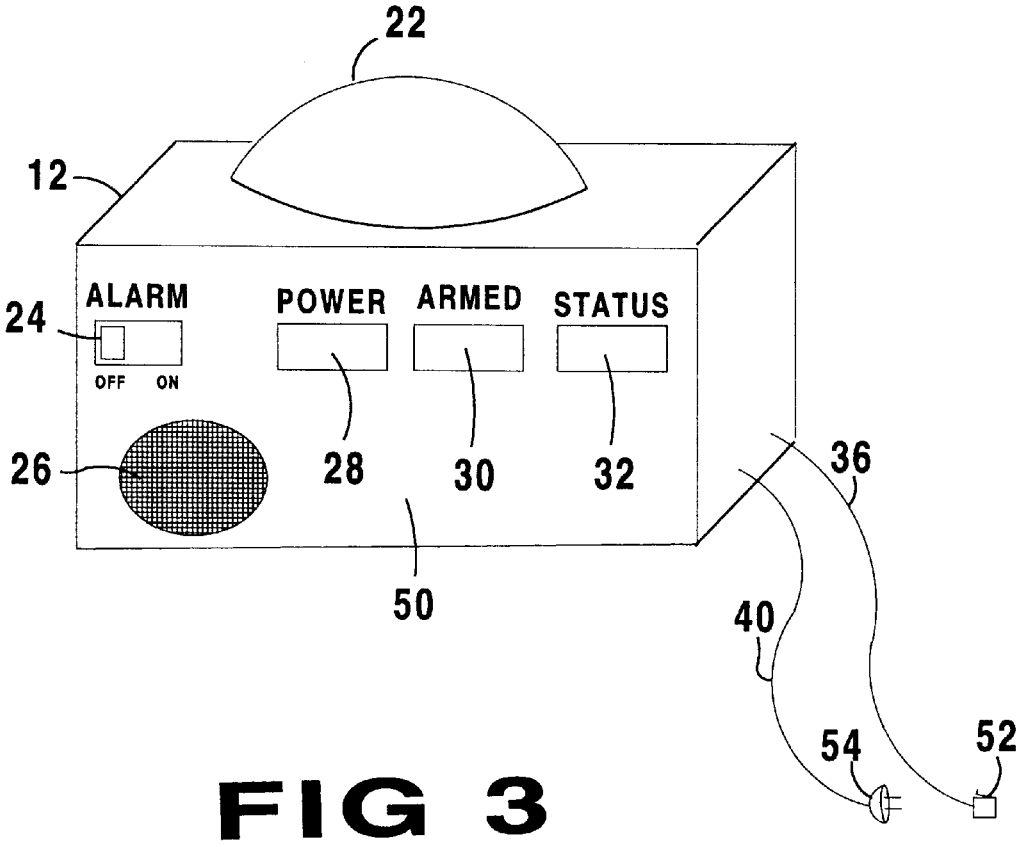
FIG. 3 is a front perspective view of the central unit of the portable alarm system of the present invention.
Figure 4:
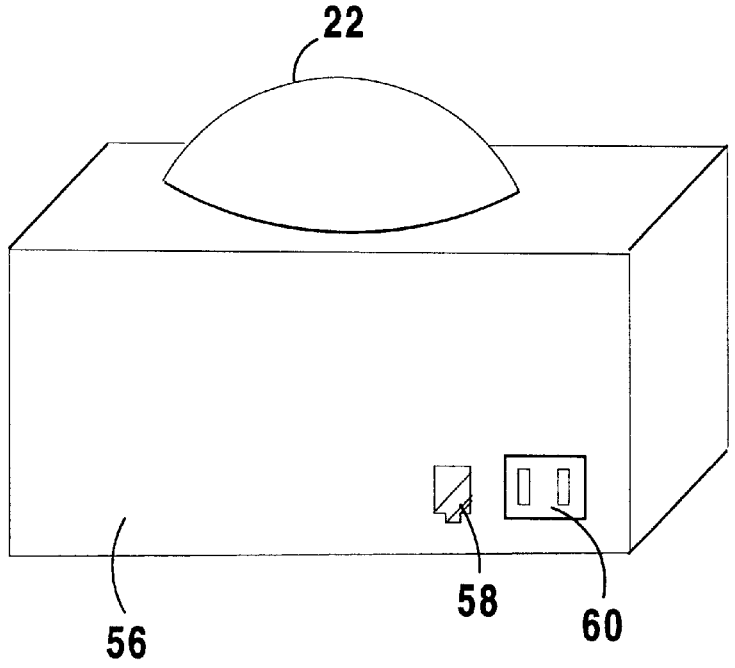
FIG. 4 is a back perspective view of the central unit of the portable alarm system of the present invention.
Figure 5:
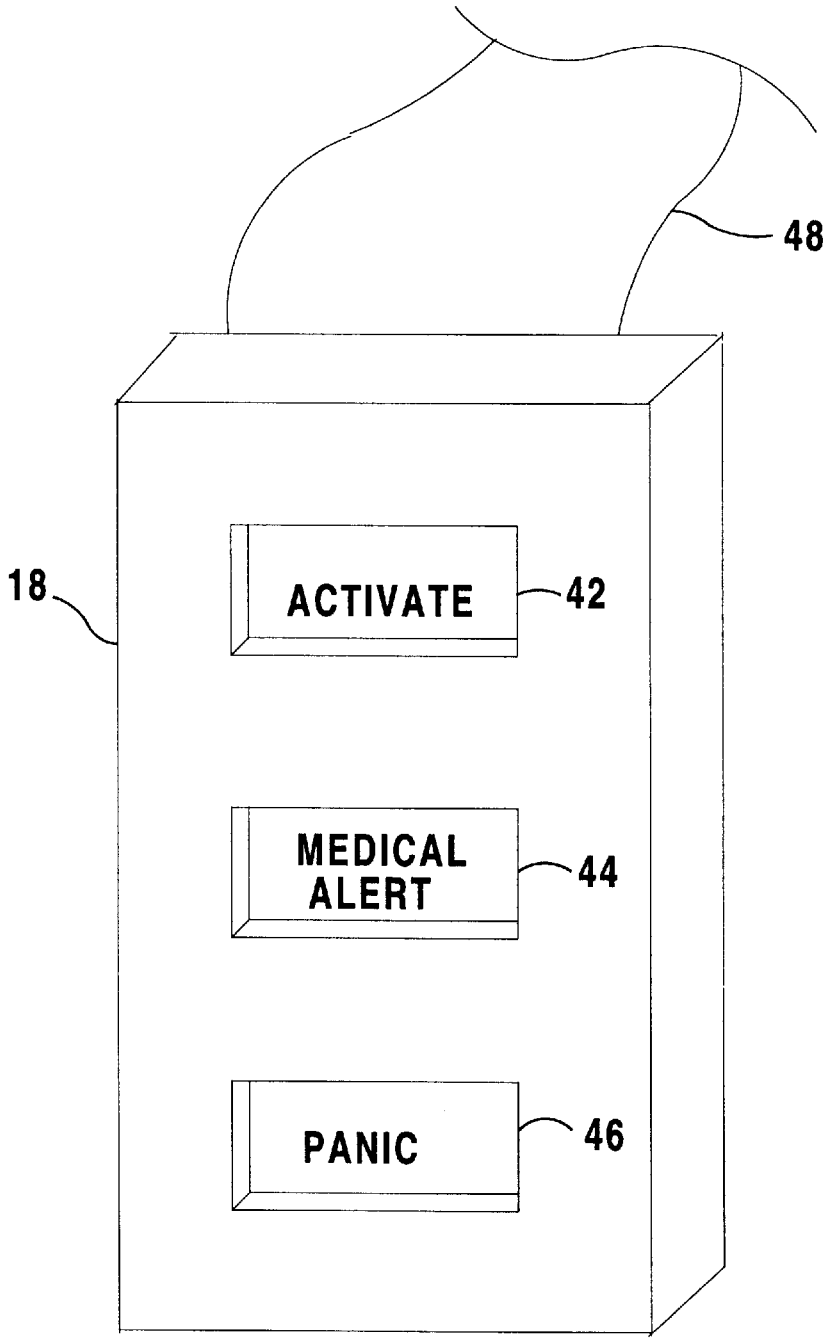
FIG. 5 is a front perspective view of the remote control unit of the portable alarm system of the present invention.

An enlarged view of the central unit 12 and remote control unit 18 is illustrated in FIG. 2. The central unit 12 is illustrated positioned on a table 14 adjacent a telephone connection port 34 and an electrical power outlet 38. As previously stated, the central unit 12 may be positioned to monitor any area desired as long as a telephone connection port 34 is located within a reachable distance therefrom. Alternatively, if it is not desired to contact the central station 85 upon detection of an emergency situation, the central unit 12 need not have access to a telephone line connection.

The central unit 12 includes a motion sensor 22 positioned on a top side of the housing 20. The motion sensor 22 is able to sense motion on all sides thereof thus forming a monitored area in the shape of a circle surrounding the central unit 12. On the face side 50 of the central unit 12 is an alarm switch 24 and a speaker 26 for producing the audible alarm signal as is clearly illustrated in FIG. 3. The alarm switch 24 allows the user to selectively turn off or mute the audible alarm signal by disconnecting the speaker 26 as will be explained hereinafter. Also provided on the face side 50 of the central unit 12 are three LEDs. A first LED 28 indicates whether the central unit 12 is turned on and monitoring the area. A second LED 30 indicates whether the central unit 12 is armed, e.g. if an emergency situation has been sensed. A third LED 32 indicates whether the central unit 12 is not operating properly, e.g. if an internal power supply is low, the telephone line is down, an electrical failure at the electrical outlet has occurred, etc.

Extending from a back side 56 of the central unit 12 is a telephone wire 36 for connection to a telephone jack 34. The back side 56 of the central unit 12 is clearly illustrated in FIG. 4. This figure illustrates a telephone cord adapter 58 for connection to the conventional telephone lines through the telephone wire 36 for calling the central station 85 upon sensing an emergency. Also extending from the back side 56 of the central unit 12 is an electrical cord 40 for connection to the electrical outlet 38. An electrical adapter 60 is provided on the back side 56 for connection to the electrical cord 40. This connection supplies the operating power for the central unit 12.

A user 16 is also shown in FIG. 2 having the remote control unit 18 secured around the neck by a chain 48. The remote control unit 18 is clearly illustrated in FIG. 5 and includes three buttons on a face side 41 thereof. The first button 42 allows the user to activate the central unit 12 from a safe distance therefrom. This allows activation of the motion sensor 22 from a safe distance thereby preventing the user 16 from causing the central unit 12 to generate a motion detection signal when leaving the monitored area. A second button 44 is provided for the user 16 to signal the central unit 12 that a medical emergency exists. This causes a signal indicating such to be transmitted to the central unit 12 whereby the central unit 12 can alert the central station 85 as to the existence of the medical emergency. A third button 46 is provided to transmit a panic signal to the central unit 12. Activation of the third button 46 causes a signal indicating a panic situation exists to be transmitted to the central unit 12 whereby the central unit 12 can notify the central station 85 as to the panic situation.

Figure 6:
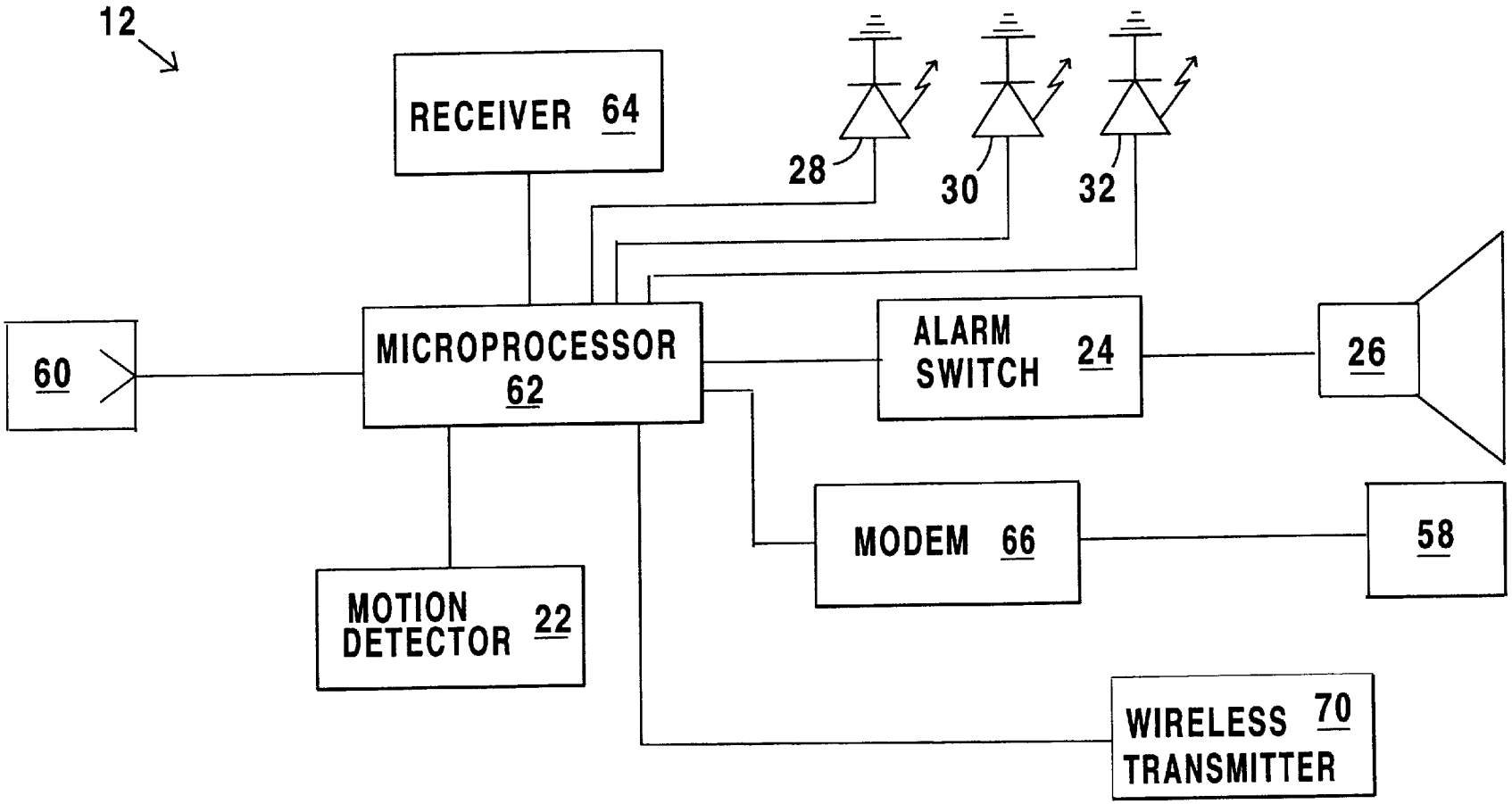
FIG. 6 is a block diagram of the central unit of the portable alarm system of the present invention.

A block diagram illustrating the internal components of the central unit 12 is shown in FIG. 6. As can be seen from this figure, the central unit 12 includes a microprocessor 62 connected to the power source via the electrical connection adapter 60. The motion detector 22 is also connected to the microprocessor 62 and transmits detection signals to the microprocessor 62. A receiver 64 is tuned to receive signals transmitted by the remote control unit 18 and relays the received signals to the microprocessor 62. The first, second and third LEDs 28, 30 and 32, respectively, are also connected to and controlled by the microprocessor 62. The microprocessor is connected to the speaker 26 via the alarm switch 24. A modem 66 and wireless transmitter 70 are also connected to the microprocessor 62. The modem 66 connects to the telephone connection port 58 for transmitting signals via conventional telephone lines to the central station 85. The transmitter 70 is provided for transmitting wireless signals to the central station 85 or to the proper authorities upon generation of an emergency signal by the microprocessor 62. The wireless transmitter 70 allows for emergency signals to be transmitted when the telephone lines are inoperative.

Figure 7:
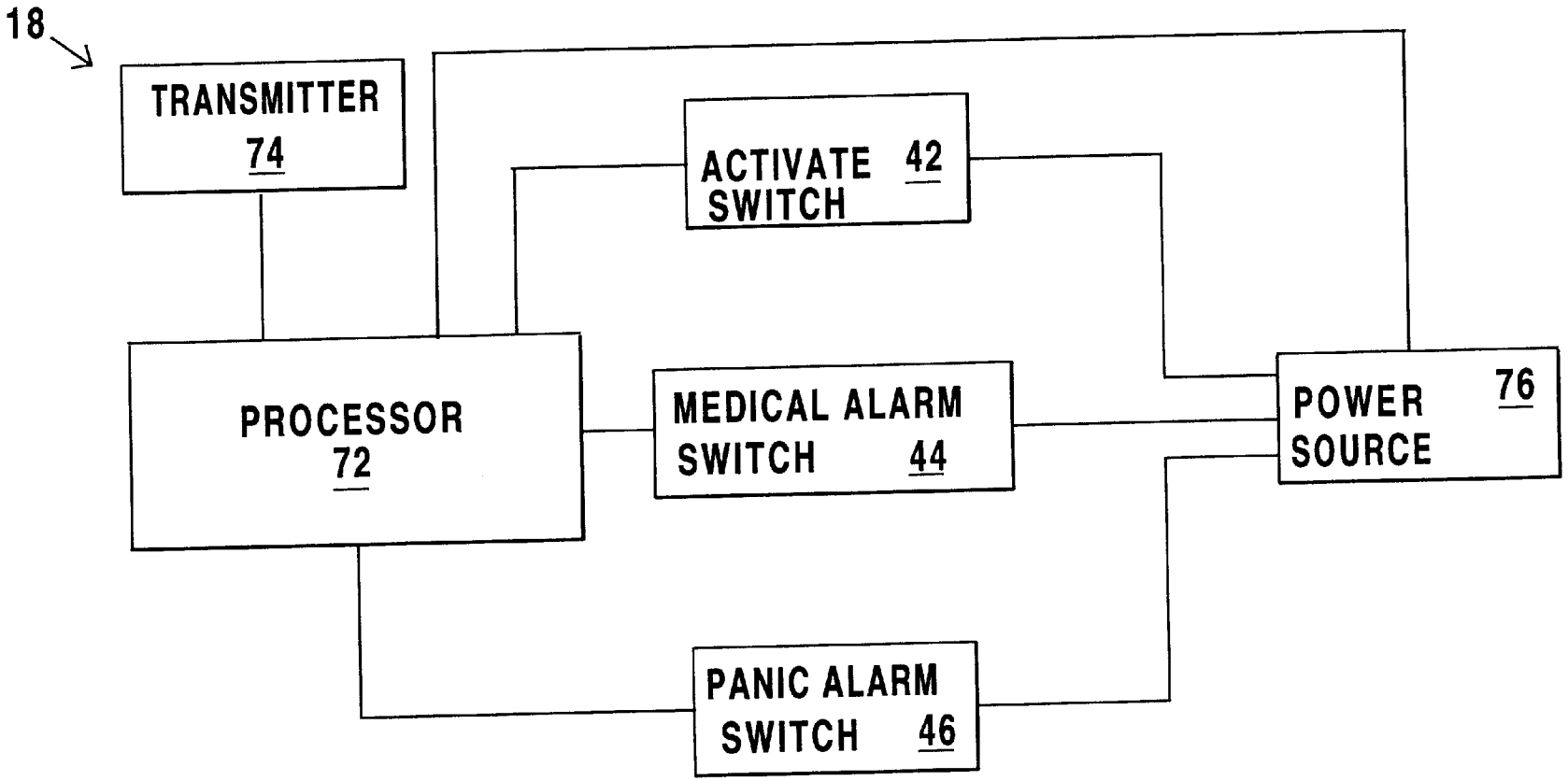
FIG. 7 is a block diagram of the remote control unit of the portable alarm system of the present invention.

A block diagram illustrating the internal components of the remote control unit 18 is shown in FIG. 7. As can be seen from this figure, the remote control unit 18 includes a processor 72 connected to a transmitter 74. The transmitter 74 will transmit the activation, medical emergency and panic signals to the central unit 12. An internal power source 76 is also connected to provide power to the microprocessor 72. Connected between the microprocessor 72 and the power source are the activate switch 42, medical alarm switch 44 and the panic alarm switch 46. When one of the activate switch 42, the medical alarm switch 44 and the panic alarm switch 46 are pressed, a voltage is applied to the processor 72. The magnitude of the voltage is dependent upon which of the activate switch 42, the medical alarm switch 44 and the panic alarm switch 46 is pressed. Each of the activate switch 42, the medical alarm switch 44 and the panic alarm switch 46 has a unique impedance associated therewith thus allowing the processor 72 to distinguish between the buttons. Alternatively, each button can be connected to a different port of the processor 72 and thus when a voltage is applied to one of the ports, the processor 72 is immediately ale to determine which button was pressed. The processor 72 generates a distinctive signal for transmission by the transmitter 74 to the central unit 12 based upon which of the buttons is pressed.

The operation of the portable alarm system 10 will now be described with reference to the figures. In operation, the central unit 12 of the portable alarm system 10 is positioned in a center of an area which is desired to be monitored. The electrical adapter 60 is connected to an electrical outlet or to an alternate power source and the telephone connection port 58 is connected to a telephone outlet for establishing a connection to the telephone system installed in the area to be monitored. The microprocessor 62 in the central unit 12 is preprogrammed to control the modem 66 to dial the telephone number of the central station 85 upon detection of motion in the monitoring area or receipt of a medical alarm signal or panic signal from the remote control unit 18. Thus, upon connecting the central unit 12 to the telephone line and a power source the central unit 12 ready to operate. In order to begin sensing motion within the desired area, the user will exit the monitoring area with the remote control unit 18 and activate the central unit 12 by pressing the activation key 42. The motion detector 22 will now monitor the monitoring area for any signs of motion.

The motion detector 22 continuously monitors the area. When motion is detected in the area, the motion detector 22 sends a signal indicative of the detection of motion to the microprocessor 62. The microprocessor 62 will control the modem 66 to dial the central station 85 to alert the central station 85 that motion has been detected in the monitored area. The location of the central unit 12 will also be relayed to the central station 85 such as through a caller ID signal. The central station 85 will now be able to take the appropriate action such as by sending law enforcement personnel over to check the monitored area. The microprocessor 62 also generates an audible alarm signal which is be provided through the speaker 26 to thereby warn persons in the area as to the detection of motion within the monitored area. If the alarm switch 24 is in the off position, the audible alarm signal will not be delivered to the speaker 26.

If the user presses the medical alert button 44, a signal will be sent to the processor 72 of the remote unit indicative of such. The processor 72 then generates a indicating the medical alert button 44 has been activated. This signal is then transmitted by the transmitter 74 to the central unit 12. The central unit 12 receives this signal at its receiver and relays the signal to the microprocessor 62. In response to receipt of this signal, the microprocessor 62 controls the modem 66 to dial the central station 85 to alert the central station that the user of the central unit 12 sending the signal needs medical attention and relay the location of the central unit 12 such as through a caller ID signal. The central station will now be able to take the appropriate action such as by sending medical personnel such as EMS technicians over to check user at the monitored area. The microprocessor 62 also generates an audible alarm signal which is be provided through the speaker 26 to thereby warn persons in the area as to the medical emergency.

If the user presses the panic button 46, a signal will be sent to the processor 72 of the remote control unit 18 indicative of such. The processor 72 then generates a signal indicating the panic button 44 has been activated. This signal is then transmitted by the transmitter 74 to the central unit 12. The central unit 12 receives this signal at its receiver and relays the signal to the microprocessor 62. In response to receipt of this signal, the microprocessor 62 controls the modem 66 to dial the central station 85 to alert the central station that the user of the central unit 12 sending the signal needs assistance and also relays the location of the central unit 12 such as through a caller ID signal. The central station will now be able to take the appropriate action such as by sending law enforcement personnel over to check user at the monitored area. The microprocessor 62 also generates an audible alarm signal which is be provided through the speaker 26 to thereby warn persons in the area as to the medical emergency.

The portable alarm system of the present invention is thus able to alert a central monitoring station as to an emergency situation, e.g. an intruder in the monitored area, a medical emergency, a panic emergency, in an area in which a central unit is positioned. The central monitoring station can then send the appropriate assistance to the monitored area. Thus, assistance can be sent to aid a person in danger by simply pressing a button.

This device can be provided by use throughout the country or even the world through a subscription service in which the central units and remote control monitoring units are rented from a provider who in turn maintains the central monitoring station.

From the above description it can be seen that the portable alarm system of the present invention is able to overcome the shortcomings of prior art devices by providing a portable alarm system which is able to monitor movement within a predetermined distance surrounding a central unit thereof. The portable alarm system includes a central unit and a remote transmitter capable of activating the central unit to monitor movement within the predetermined area and activate the central unit to generate an alarm signal indicative of at least one of a medical emergency and a panic situation. The portable alarm system also includes a modem and telephone connector for communicating with a central station and relaying emergency signals thereto, an audible alarm for generating an audible alarm signal upon detection of motion within the predetermined area and an LED display on the central unit for alerting the user to the status of the central unit. Furthermore, the portable alarm system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable alarm system comprising:

a) a central station;

b) a number of central units, each central unit for monitoring a desired area including:

i) means comprising a motion detector for detecting an emergency situation and generating a detection signal in response to detecting an the emergency situation;

ii) processing means connected to said detecting means for receiving said detection signal and generating an audible alarm signal in response to receipt thereof;

iii ) a receiver connected to said processing means for receiving an emergency signal and sending said emergency signal to said processing means; and iv) means for alerting the central station upon receipt of one of said alarm signal and emergency signal from said processing means;

c) a remote control unit for generating a signal for activating said motion detector including:

i) means for generating said emergency signal in response to receipt of a user generated command;

ii) a transmitter for wirelessly transmitting said emergency signal to said receiver of said central unit; and iii) means comprising a neck chain for releasably securing said remote control unit to a user; and d) said central station including means for identifying the location of said central unit through a caller ID signal, said central station including a housing having first, second and third indicators on a face side thereof, said first indecator providing a visual signal that said central unit is receiving power, said second indicator providing a visual signal that an emergency situation has been detected and said third indicator providing a visual signal that a power interruption has occurred, said first, second and third indicators being light emitting diodes.

* * * * *